US005804351A

United States Patent [19]

Takano et al.

[11] Patent Number: 5,804,351

[45] Date of Patent: Sep. 8, 1998

[54] TONER FOR ELECTROSTATIC-IMAGE DEVELOPMENT, DEVELOPER FOR ELECTROSTATIC IMAGE, AND IMAGE FORMING PROCESS USING THE SAME

[75] Inventors: Hiroshi Takano; Masanori Ichimura; Masaki Hashimoto; Hideyuki Akagi; Kazuya Furuta; Koji Fukushima; Masahiro Takagi; Kensaku Togao; Satoru Ishigaki; Michio Take; Yuka Ishihara, all of Minami-ashigara, Japan

[73] Assignee: Fuji Xerox Co., Ltd., Tokyo, Japan

[21] Appl. No.: 730,932

[22] Filed: Oct. 16, 1996

[30] Foreign Application Priority Data

Nov. 2, 1995 [JP] Japan ..... 7-285830

[51] Int. Cl.[6] ..... G03G 9/08

[52] U.S. Cl. ..... 430/111; 430/110

[58] Field of Search ..... 430/111, 110, 430/109

[56] References Cited

U.S. PATENT DOCUMENTS

| | | | |
|---|---|---|---|
| 2,221,776 | 11/1940 | Carlson . | |
| 2,618,552 | 11/1952 | Wise . | |
| 2,874,063 | 2/1959 | Greig . | |
| 5,288,578 | 2/1994 | Sugizaki et al. | 430/108 |

FOREIGN PATENT DOCUMENTS

| | | |
|---|---|---|
| 0 331 425 A2 | 9/1989 | European Pat. Off. . |
| 0 332 428 A2 | 9/1989 | European Pat. Off. . |
| 0 395 026 A2 | 10/1990 | European Pat. Off. . |
| 0 606 100 A1 | 7/1994 | European Pat. Off. . |
| B2-59-11103 | 3/1984 | Japan . |
| A-62-103675 | 5/1987 | Japan . |
| B2-63-53542 | 10/1988 | Japan . |
| B2-1-27417 | 5/1989 | Japan . |
| 2-139575 A | 5/1990 | Japan . |
| A-2-132459 | 5/1990 | Japan . |
| B2-6-56513 | 7/1994 | Japan . |
| B2-6-93136 | 11/1994 | Japan . |

*Primary Examiner*—Marion E. McCamish
*Assistant Examiner*—Cheryl Juska
*Attorney, Agent, or Firm*—Oliff & Berridge, PLC

[57] ABSTRACT

A toner for electrostatic-image development which comprises toner particles comprising a colorant and a binder resin, the toner particles having a volume-average particle diameter of from 3 to 9 μm and a particle size distribution satisfying the following expressions (1) and (2):

$$D16(v)/D50(v) \leqq 1.475-0.036\times D50(v) \quad (1)$$

$$D50(p)/D84(p) \leqq 1.45 \quad (2)$$

wherein D16(v) and D50(v) represent, in terms of absolute value, a cumulative 16% diameter (μm) and a cumulative 50% diameter (μm), respectively, of a cumulative volume particle diameter distribution of the toner particles depicted from the larger diameter side, and D50(p) and D84(p) represent, in terms of absolute value, a cumulative 50% diameter (μm) and a cumulative 84% diameter (μm), respectively, of a cumulative population particle diameter distribution of the toner particles depicted from the larger diameter side.

6 Claims, No Drawings

TONER FOR ELECTROSTATIC-IMAGE DEVELOPMENT, DEVELOPER FOR ELECTROSTATIC IMAGE, AND IMAGE FORMING PROCESS USING THE SAME

FIELD OF THE INVENTION

The present invention relates to a toner for use in developing an electrostatic latent image, a developer for an electrostatic image, and an image forming process using the same.

BACKGROUND OF THE INVENTION

In electrophotography, known conventional processes for converting an electrostatic latent image formed on a photoconductive photoreceptor or the like into a visible image with using a toner include, for example, the magnetic blush development described in U.S. Pat. No. 2,874,063, the magnetic cascade development described in U.S. Pat. No. 2,618,552, and the powder cloud development described in U.S. Pat. No. 2,221,776. The toners generally used for these development processes comprise a mixture of a thermoplastic resin and a colorant. The toner image formed on the photoconductive photoreceptor or the like by the above or other development processes is transferred to a support such as paper and fixed thereto by applying pressure and/or heat. With the recent increasing desire for higher image quality in copies, various improvements are being made in both copiers and developers. In particular, a technique frequently used for improving image quality is to employ toner particles having a reduced average particle diameter. Although use of toner particles having a reduced average particle diameter is an effective means for improving image quality, this technique is disadvantageous in that the tribo (charge amount per unit weight) increases, resulting in difficulties in obtaining a desired density, and that the amount of charges which the toner can have per particle decreases, resulting in more frequent blurring. Thus, such toners are limited in kind thereof when used. If a toner is merely regulated so as to have a reduced particle diameter, there may be a problem, for example, that when a toner image is fixed to an image support, e.g., paper, toner particles disadvantageously embed themselves into spaces among paper fibers, making reproduction of a desired color impossible. In particular, in the case of toner production through kneading and pulverization, there is a problem that the smaller the average particle diameter, the higher the cost.

To mitigate the various problems described above, various toners having a regulated particle size distribution have been proposed so far. For example, a toner having a specific particle size distribution with an average particle diameter of from 7 to 14 $\mu$m is proposed in JP-A-62-103675 (the term "JP-A" as used herein means an "unexamined published Japanese patent application"), and a toner having a narrow particle size distribution is proposed in JP-A-2-132459. In general, a broad particle size distribution tends to result in reduced charge retention to reduce in so-called life. This is because larger toner particles, which are more suitable for development, are used in development, while relatively smaller toner and the like remain in the developing machine over a prolonged time period. Although toners having a narrower particle size distribution are desirable, the attainable narrowness has been limited from the standpoints of toner production and cost. The toners described in the above described publications cannot provide a high-quality image because the particle size distributions thereof are not narrow with respect to the larger-particle side or the smaller-particle side. Moreover, the toner described in JP-A-2-132459 has a problem that since it contains fine particles having smaller particle diameters, it is apt to cause blurring and can provide only images having poor graininess.

Furthermore, toner particles having larger particle diameters influence image properties other than graininess. Specifically, image areas where large toner particles have been fixed have high gloss, while image parts where small toner particles have been fixed have low gloss and suffer microscopic unevenness of gloss, especially in small-pile-height areas. This tendency becomes remarkable in toners having a larger average particle diameter. Still another problem of conventional toners is that small toner particles present near large toner particles are less apt to be transferred in the transferring step, resulting in microscopic unevenness of transfer or white dots.

SUMMARY OF THE INVENTION

The present invention has been achieved in order to eliminate problems as described above.

An object of the present invention is to provide a toner for electrostatic-image development, in which the toner particles are not excessively small and which provides blurring-free high-quality images despite such toner particle diameters, and to provide a developer for electrostatic images which comprises the toner.

Another object of the present invention is to provide a toner for electrostatic-image development with which an electrostatic latent image is faithfully developed and which thus forms an excellent transferred image to provide a high-quality image, and to provide a developer for electrostatic images which comprises the toner.

Still another object of the present invention is to provide a image forming process with which a high-quality image can be obtained.

As a result of investigations made by the present inventors in order to eliminate the above-described problems of conventional techniques, it was found that those problems are mitigated by regulating a toner so as to have a specific particle size distribution. The present invention has been completed based on this finding.

An embodiment of the toner for electrostatic-image development of the present invention comprises toner particles comprising a colorant and a binder resin, the toner particles having a volume-average particle diameter of from 3 to 9 $\mu$m and a particle size distribution satisfying the following expressions (1) and (2):

$$D16(v)/D50(v) \leqq 1.475-0.036\times D50(v) \quad (1)$$

$$D50(p)/D84(p) \leqq 1.45 \quad (2)$$

wherein D16(v) and D50(v) represent, in terms of absolute value, a cumulative 16% diameter ($\mu$m) and a cumulative 50% diameter ($\mu$m), respectively, of a cumulative volume particle diameter distribution of the toner particles depicted from the larger diameter side, and D50(p) and D84(p) represent, in terms of absolute value, a cumulative 50% diameter ($\mu$m) and a cumulative 84% diameter ($\mu$m), respectively, of a cumulative population particle diameter distribution of the toner particles depicted from the larger diameter side.

An another embodiment of the toner according to the present invention comprises toner particles comprising a colorant and a binder resin, the toner having external additives comprising (a) an external additive having an average particle diameter of from not less than 20 nm to less than 100 nm and (b) an external additive having an average particle diameter of from not less than 7 nm to less than 20 nm:

wherein the toner particles have a volume-average particle diameter of from 3 to 9 μm and a particle size distribution satisfying the above described expressions (1) and (2);

wherein the toner particles are covered with external additive (a) at a coverage of at least 20%, and with external additive (b) at a coverage of at least 40%, of the total surface area of the toner particles; and wherein the total of the coverages with external additives (a) and (b) is from not less than 60% to less than 120% based on the total surface area of the toner particles.

The coverage used in the present invention is a calculated value obtained by converting an addition amount of an external additive. Consequently, in the case where external additives are added in an amount such that 120% of the toner surface area can be covered therewith, the total coverage is taken as 120%.

An embodiment of the developer for electrostatic images of the present invention comprises (A) toner particles comprising a colorant and a binder resin and (B) a carrier, the toner particles having a volume-average particle diameter of from 3 to 9 μm and a particle size distribution satisfying the above described expressions (1) and (2), and the carrier being a resin-coated carrier.

An another embodiment of the developer for electrostatic images of the present invention comprises:

(A) toner particles comprising a colorant and a binder resin and having external additives comprising (a) an external additive having an average particle diameter of from not less than 20 nm to less than 100 nm and (b) an external additive having an average particle diameter of from not less than 7 nm to less than 20 nm; and (B) a resin-coated carrier:

wherein the toner particles have a volume-average particle diameter of from 3 to 9 μm and a particle size distribution satisfying the above described expressions (1) and (2);

wherein the toner particles are covered with external additive (a) at a coverage of at least 20%, and with external additive (b) at a coverage of at least 40%, of the total surface area of the toner particles; and wherein the total of the coverages with external additives (a) and (b) is from not less than 60% to less than 120% based on the total surface area of the toner particles.

An embodiment of the image forming process of the present invention comprises the steps of: forming a latent image on a latent-image holder; forming a toner image on the latent-image holder with a developer on a developer container; transferring the toner image to an image support; and fixing the toner image to the image support, wherein the developer comprises toner particles comprising a colorant and a binder resin and having a volume-average particle diameter of from 3 to 9 μm and a particle size distribution satisfying the above described expressions (1) and (2).

An another embodiment of the image forming process of the present invention comprises the above described steps, wherein the developer comprises a resin-coated carrier and toner particles, the toner particles comprising a colorant and a binder resin and having a volume-average particle diameter of from 3 to 9 μm and a particle size distribution satisfying the above described expressions (1) and (2).

In these processes, the toner image formed on the latent-image holder may be indirectly transferred from the latent-image holder to the image support using an intermediate transfer medium.

A still another embodiment of the image forming process of the present invention comprises the above described steps, wherein the image support having a surface smoothness (Sp) satisfying the following expression (7):

$$Sp \geqq 5 \times TMA^{-3} \quad (7)$$

wherein Sp represents the surface smoothness of the image support, and TMA represents the toner amount per unit area ($mg/cm^2$) necessary for obtaining a primary-color density of 1.7, both in terms of absolute value.

In the above described image forming processes, the relationship between the volume-average particle diameter of the toner particles (D50(v)) and a weight of the toner adhering to a monochromatically colored area of the image support (TMA) is preferably represented by the following expression (3):

$$0.116 \times D50(v)/2 \leqq TMA \leqq 0.223 \times D50(v)/2 \quad (3)$$

wherein TMA represents the toner amount per unit area ($mg/cm^2$) necessary for obtaining a primary-color density of 1.7, in terms of absolute value, and D50(v) is the same as defined above.

Further, in the above described toners, developers and image forming processed, the relationship between the volume-average particle diameter of the toner particles (D50(v)) and a colorant content in the toner particles (c) is preferably represented by the following expression (4):

$$22/D50(v) \leqq c \leqq 43/D50(v) \quad (4)$$

wherein c represents the colorant content (wt %), and D50(v) is the same as defined above.

Furthermore, the toner particles preferably have a melt viscosity satisfying the following expressions (5) and (6):

$$1 \times 10^5 \leqq \eta(90°\ C.) \leqq 1 \times 10^6 \quad (5)$$

$$1 \times 10^4 \leqq \eta(100°\ C.) \leqq 1 \times 10^5 \quad (6)$$

wherein η(90° C.) and η(100° C.) represent the melt viscosity (Pa·s) of the toner at 90° C. and 100° C., respectively.

DETAILED DESCRIPTION OF THE INVENTION

The present invention is explained in detail below.

The toner particles in the present invention comprise a binder resin and a colorant as the main components.

Examples of the binder resin for use in the present invention include homopolymers and copolymers of: styrene and styrene derivatives such as chlorostyrene; monoolefins such as ethylene, propylene, butylene and isobutylene; vinyl esters such as vinyl acetate, vinyl propionate, vinyl benzoate and vinyl butyrate; esters of aliphatic α-methylene monocarboxylic acids such as methyl acrylate, ethyl acrylate, butyl acrylate, octyl acrylate, dodecyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone. Examples of especially representative binder resin include polystyrene, styrene-alkyl acrylate copolymers, styrene-alkyl methacrylate copolymers, styrene-acrylonitrile copolymers, styrene-butadiene copolymers, styrene-maleic anhydride copolymers, and polyolefins such as polyethylene and polypropylene. Further examples of the binder resin include polyesters, polyurethanes, epoxy resins, silicone resins, polyamides, modified rosins and paraffin waxes.

Polyester resins are preferably used because of their superiority in low-temperature fixability.

The polyester resins preferably used in the present invention are synthesized from a polyhydric alcohol ingredient and a polycarboxylic acid ingredient.

Examples of the polyhydric alcohol ingredient include ethylene glycol, propylene glycol, 1,4-butanediol, 2,3-butanediol, diethylene glycol, triethylene glycol, 1,5-pentanediol, 1,6-hexanediol, neopentylene glycol, 1,4-cyclohexanedimethanol, dipropylene glycol, polyethylene glycol, polypropylene glycol, bisphenol A, hydrogenated bisphenol A, and the like. Especially preferred of these polyhydric alcohol ingredients are bisphenol A derivatives represented by the following formula:

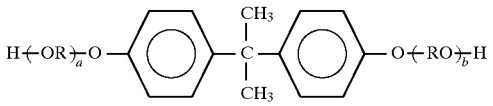

wherein R represents an ethylene or propylene group, and a and b each is an integer, provided that the sum of both is from 2 to 7.

Specific examples of the bisphenol A derivatives include polyoxypropylene(6.0)-2,2-bis(4-hydroxyphenyl)-propane, polyoxyethylene(2.2)-2,2-bis(4-hydroxyphenyl)-propane, and polyoxypropylene(2.0)-polyoxyethylene(2.0)-2,2-bis(4-hydroxyphenyl)propane. Usable trihydric and higher alcohol ingredients include glycerol, sorbitol, 1,4-sorbitan and trimethylolpropane.

Examples of the polycarboxylic acid ingredient include maleic acid, maleic anhydride, fumaric acid, phthalic acid, terephthalic acid, isophthalic acid, malonic acid, succinic acid, glutaric acid, n-octylsuccinic acid, n-dodecenylsuccinic acid, 1,2,4-benzenetricarboxylic acid, 1,2,4-cyclohexanetricarboxylic acid, 1,2,4-naphthalenetricarboxylic acid, 1,2,5-hexanetricarboxylic acid, 1,3-dicarboxy-2-methyl-2-carboxymethylpropane, tetra(carboxymethyl)methane, 1,2,7,8-octanetetracarboxylic acid, trimellitic acid, pyromellitic acid, and lower-alkyl esters of these acids.

The polyester resin described above preferably has a number-average molecular weight $M_n$ of from 2,500 to 3,500. If the number-average molecular weight thereof exceeds 3,500, the pulverizability of the resulting toner is reduced, resulting in impaired production efficiency. On the other hand, number-average molecular weights thereof lower than 2,500 lead to reduced toner image strength and overpulverization (toner particles are pulverized within the developing machine of a copier). The polyester resin preferably has a weight-average molecular weight $M_w$ of from 7,000 to 300,000. If the weight-average molecular weight thereof exceeds 300,000, pulverizability is reduced, resulting in impaired production efficiency. On the other hand, polyester resins having a weight-average molecular weight lower than 7,000 have reduced molecular cohesive force, resulting in reduced toner releasability.

The above described binder resins may be used alone or in combination of two or more thereof.

Examples of the colorant include carbon black, aniline blue, calco oil blue, chrome yellow, ultramarine blue, Dupont Oil Red, quinoline yellow, methylene blue chloride, copper phthalocyanine, malachite green oxalate, lamp black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Yellow 17, C.I. Pigment Blue 15:1 and C.I. Pigment Blue 15:3. Other examples of the colorant include magnetic powder, titanium oxide and zinc oxide. The content of the colorant in the toner particles can be appropriately selected depending on the specific gravity or coloring power of the colorant, but the content is generally from 2 to 50% by weight based on the total weight of the toner particles.

A release agent may be added to the toner particles of the present invention if desired and necessary. Examples of materials which is used as a component of the release agent include polyolefins such as polyethylene and polypropylene, modified polyolefins obtained by modifying such polyolefins with maleic anhydride or other modifiers, vegetable waxes such as carnauba wax, rice wax, candelilla wax and hohoba wax, petroleum waxes such as paraffin wax and microcrystalline wax, other waxes such as montan wax and Fischer-Tropsh wax, and amides such as ethylenebisstearic acid amide. The release agent should not be construed as being limited to these examples.

Besides the ingredients described above, the toner particles may further contain a charge control agent, a cleaning aid and a fluidizing agent according to need.

Representative examples of the charge control agent include compounds of salicylic acid with a metal, quaternary ammonium salts, Cr-containing dyes, and resins containing these charge control functional groups. If desired and necessary, these charge control agents may be used as a mixture of two or more thereof.

The toner particles for use in the present invention can be obtained by kneading a colorant and a binder resin together with other ingredients with heating, and pulverizing the mixture, followed by classification. The toner particles thus produced should have a volume-average particle diameter of from 3 to 9 μm and a particle size distribution satisfying the following expressions (1) and (2).

$$D16(v)/D50(v) \leqq 1.475-0.036\times D50(v) \quad (1)$$

$$D50(p)/D84(p) \leqq 1.45 \quad (2)$$

If toner particles have a volume-average particle diameter smaller than 3 μm, the amount of charges which the toner can have per particle is reduced, resulting in poor image quality with considerable blurring. If toner particles have a volume-average particle diameter exceeding 9 μm, the graininess of the toner particles is impaired and the toner provide an image having a rough surface.

Further, regulating the toner particles so as to have a particle size distribution within the range defined by the above expressions is necessary from the standpoint of image quality improvement. If the larger-particle-side particle size distribution, D16/D50, exceeds the range defined by expression (1), the toner particles show impaired graininess and give an image with a rough surface. If the smaller-particle-side particle size distribution, D50/D84, exceeds 1.45, the toners give a somewhat blurred image and, in addition, tends to have impaired graininess. Furthermore, in the case where external additives are added to such toner particles, a large proportion of the external additives adhere to larger toner particles, and the amount of the external additives adhering to toner particles having the central particle diameter is hence lower than the desired amount, resulting in impaired transferability.

In order to obtain a high-quality image, it is necessary to more faithfully reproduce an electrostatic latent image formed on a latent-image holder, e.g., a photoconductive photoreceptor. However, faithfulness to the electrostatic latent image is gradually impaired through the steps of development, transfer and fixing. In particular, image quality considerably deteriorates upon transfer. Although a detailed mechanism has not been elucidated, use of a toner having a broad particle size distribution results in considerable toner flying during transfer. In particular, flying of large toner particles causes significant image quality deterioration. In the case where a toner having a broad particle size distribution with respect to the smaller-particle side is used in combination with external additives, the external additives are less apt to adhere to smaller toner particles, and this tends to cause transfer failure. These troubles can be avoided and high-quality images can be obtained by regulating a toner so as to have a larger-particle-side particle size distribution within the range defined by expression (1) and to have a smaller-particle-side particle size distribution within the range defined by expression (2). Namely, by regulating a toner so as to have a particle size distribution within the above range, the particle size distribution becomes narrow and toner particles can be arranged on an electrostatic latent image extremely faithfully. Thus, an effect in improving image quality is obtained. The particle size distribution as required in the present invention can be attained by appropriately selecting a pulverization condition and a classifying condition.

External additives may be added to the toner particles for use in the present invention to cover the surface of the toner particles. Examples of the external additives for use in the present invention include fine powder of inorganic materials such as $TiO_2$, $SiO_2$, $Al_2O_3$, MgO, CuO, ZnO, $SnO_2$, $CeO_2$, $Fe_2O_3$, BaO, $CaO.SiO_2$, $K_2O(TiO_2)_n$, $Al_2O_3.2SiO_2$, $CaCO_3$, $MgCO_3$, $BaSO_4$, $MgSO_4$, $MoS_2$, silicon carbide, boron nitride, carbon black, graphite and graphite fluoride, and fine powder of polymers such as polycarbonates, poly(methyl methacrylate), polystyrene and poly(vinylidene fluoride). These external additives may be used alone or as a mixture of two or more thereof. The addition amount of the external additive is generally from 0 to 5% by weight, preferably from 0.5 to 3% by weight, based on the total weight of the toner.

A combination of $TiO_2$ and $SiO_2$ is preferably used in the present invention.

In the case of using those external additives, they are preferably added in such a manner that an external additive having an average particle diameter of from not less than 20 nm to less than 100 nm is added to give a coverage at least 20% based on the total surface area of the toner particles, an external additive having an average particle diameter of from not less than 7 nm to less than 20 nm is added to give a coverage of at least 40% based on the total surface area of the toner particles, and that the total of the two coverages with the external additives is within the range of from not less than 60% to less than 120% based on the total surface area of the toner particles. The total surface area of toner particles is represented by expression (8):

$$\Sigma\pi d_x^2 \cdot n_x \tag{8}$$

wherein $d_x$ represents the diameter of a toner particle, and $n_x$ represents the number of the toner particle.

By regulating the coverage of the external additive having an average particle diameter of from not less than 20 nm to less than 100 nm to at least 20% based on the total surface area of the toner particles, it is possible to reduce the toner/latent-image holder contacting area and to thereby obtain stable transferability over a long period of time. By regulating the coverage of the external additive having an average particle diameter of from not less than 7 nm to less than 20 nm to at least 40% based on the total surface area of the toner particles, stable flowability can be obtained over a long period of time. Further, by regulating the total coverage with these two kinds of external additives to from not less than 60% to less than 120% based on the total surface area of the toner particles, the occurrence of comets and filming are reduced and good graininess is obtained, whereby satisfactory images are obtained stably over a long period of time.

Although the toner of the present invention described above can be used alone as a one-component developer, it can also be used as a two-component developer with using a carrier in combination. Examples of the carrier for use in the two-component developer include magnetic particles of ferrites, iron oxide powder, nickel, etc., coated carriers obtained by coating these magnetic particles with a resin, and dispersion type carriers comprising magnetic particles dispersed in a binder resin. Preferred of these are coated carriers comprising magnetic particles coated with a resin from the standpoint of durability. Examples of the coating resin for use in the coated carrier include fluororesins, silicone resins and acrylic resins. In general, carriers having a particle diameter of from 20 to 100 $\mu$m are preferably used.

In the case of the two-component developer, the mixing ratio of toner particles to the carrier may be suitably selected. However, the ratio is preferably from 1/99 to 15/85 by weight.

The image forming process of the present invention comprises the steps of forming a latent image on a latent-image holder, e.g., a photoconductive photoreceptor, forming a toner image on the latent-image holder with a developer on a developer container, and transferring the toner image to an image support, the developer being a one-component or two-component developer comprising the above described toner particles. The toner image transferred to the image support is fixed thereto. In the case where the image support used is paper or the like, the support preferably has a surface smoothness (Sp) satisfying expression (7):

$$Sp \geqq 5 \times TMA^{-3} \tag{7}$$

wherein Sp represents the surface smoothness of the image support, and TMA represents the toner amount per unit area ($mg/cm^2$) necessary for obtaining a primary-color density of 1.7, both in terms of absolute value. Especially preferably, $Sp \geqq 10 \times TMA^{-3}$. TMA can be adjusted by controlling a sensitivity of a photoreceptor, an exposure amount and a charge amount of a toner.

In the present invention, use of an image support having a surface smoothness within the above range is effective in improving image quality. In particular, in the formation of a color image, colors formed by color superposition can be exceedingly well reproduced by use of such an image support and color unevenness can be inhibited. The surface smoothness can be controlled in producing paper, generally, at the calendering step.

In the above case, the relationship between the volume-average particle diameter of the toner particles (D50(v)) and a weight of the toner adhering to a monochromatically colored area of the image support (TMA) is preferably represented by expression (3):

$$0.116 \times D50(v)/2 \leqq TMA \leqq 0.223 \times D50(v)/2 \tag{3}$$

wherein TMA represents the toner amount per unit area ($mg/cm^2$) necessary for obtaining a primary-color density of 1.7, in terms of absolute value, and D50(v) is the same as defined above.

By regulating TMA to a value in the range of from 0.116×D50(v)/2 to 0.223×D50(v)/2, a desired image density is readily obtained so that readability of printed matters is improved.

In the present invention, the relationship between the volume-average particle diameter of the toner particles (D50(v)) and the colorant content in the toner particles (c) is preferably represented by expression (4):

$$22/D50(v) \leqq c \leqq 43/D50(v) \quad (4)$$

wherein c represents the colorant content (wt %) and D50(v) is the same as defined above.

By regulating the colorant content (c) to a value in the range of from 22/D50(v) to 43/D50(v), a desired image density is readily obtained so that readability of printed matters is improved.

Moreover, by regulating the toner particles so as to have a melt viscosity η(90° C.) in the range of from $1\times10^5$ to $1\times10^6$ and a melt viscosity η(100° C.) in the range of from $1\times10^4$ to $1\times10^5$, excellent images having reduced color unevenness can be obtained even when an image support having a low surface smoothness is used. Those melt viscosity values (Pa·s) of the toner are determined by measurement using a flow tester at those temperatures. The melt viscosity of the toner particles can be adjusted by appropriately selecting the kind of the binder resin for use in the toner particles, the molecular weight of the binder resin and its distribution.

In general, toners having smaller particle diameters show stronger interaction with an image support. This is a phenomenon in which toner particles embed themselves into spaces among fibers in an image support, when the support is made of paper or a similar material, resulting in images reduced in concentration and/or gloss. For example, in the case of full-color image formation, such fine toner particles may deteriorate the reproduction of colors formed by superposition of colors, e.g., red, blue and green. For avoiding such entrance of toner particles into spaces among fibers in paper or the like, it is necessary to regulate the surface smoothness of the image support. Those problems are eliminated by regulating the surface smoothness of the image support so as to satisfy expression (7) or by regulating the melt viscosity of the toner particles.

Furthermore, the reduction in toner particle size generally tends to considerably narrow the range of toner concentration within which a toner can be used as developers. By preferably regulating the colorant content of the toner so as to satisfy expression (4), a toner having a reduced particle diameter can be used without causing troubles. This is because a desired image density can be obtained even when a small toner amount is used in development by the above regulation. However, when only this expedient is taken, the resulting image may have too high a maximum density and a poor appearance. It is therefore preferred to regulate the amount of the toner adhering to a maximum-density monochromatic area per unit area so as to satisfy expression (3).

The present invention will be explained below in detail by reference to the following Examples, but the invention should not be construed as being limited to these Examples. Hereinafter, all parts are by weight.

Particle diameter and particle diameter distribution were determined with Coulter Counter of TA2 type. With respect to coverages, addition of external additives was carried out with a calculated addition amount such that the objective coverage can be obtained, where the total surface area of the toner particles, $\Sigma\pi d^2 n_x$, calculated from the results of measurement with the Coulter Counter was took as 100%. In the calculation, the surface area of one toner particle (S) was obtained by dividing $\Sigma\pi d_x^2 \cdot n_x$ with the count number of the toner particles measured with the Coulter Counter, and then the radius of the toner particle was determined from the surface area S. Addition amounts of external additives were calculated from the following expression:

$$f=(\sqrt{3}/2\pi)\times(D/d)\times(\rho_c/\rho_e)\times c$$

wherein f represents a coverage of an external additive, D and d, respectively, represent diameters of a toner particle and the external additive, $\rho_c$ and $\rho_e$, respectively, represent specific gravities of the toner particle and the external additive, and c represents a weight percentage of the external additive. The objective coverage was regarded as the coverage. For the measurement of image density, densitometer of X-Rite 404 type, manufactured by X-Rite Co., was used. The surface smoothness of each image support was measured in accordance with JIS P8119 (which is substantially the same with TAPPI standard T 479 su-71); the higher the Sp value, the higher the surface smoothness. The melt viscosities (Pa·s) of toner particles were measured at the respective temperatures with a flow tester (CFT-500C, manufactured by Shimadzu Corp.) under the conditions of an initiation temperature of 80° C., a preheating time of 300 seconds, a pressure of 0.980665 MPa, and a die size of 1 mm in diameter×1 mm.

EXAMPLE 1

| (Toner) | |
|---|---|
| Polyester binder polymer (terephthalic acid/ethylene oxide adduct of bisphenol A) ($M_w$: about 10,000) (trade name: NE382, manufactured by Kao Corp.) | 95 parts |
| Colorant (C.I. Pigment Red 57:1) | 5 parts |

The ingredients shown above were kneaded with a twin-screw kneader, and the resulting mixture was pulverized and classified to obtain toner particles having a volume-average particle diameter (D50(v)) of 7 μm. The toner particles had a D16(v)/D50(v) of 1.21 and a D50(p)/D84(p) of 1.25. To 100 parts of the resulting toner particles were added 1 part of fine silica particles. This mixture was treated with a Henschel mixer and then sifted with a screen having a mesh size of 45 μm.

| (Carrier) | |
|---|---|
| Cu—Zn—Fe cores (50 μm) | 100 parts |
| Fluorine-containing acrylic polymer | 0.5 parts |

The ingredients shown above were mixed by means of a kneader and then dried to obtain carrier particles having a volume-average particle diameter of about 50 μm.

(Developer)

The toner was mixed with the carrier in a weight ratio of 10:100 to prepare a magenta developer.

EXAMPLE 2

A developer was prepared in the same manner as in Example 1, except that the colorant was replaced by C.I. Pigment Blue 15:3, and that in the pulverization and classification steps, toner particles were regulated to have a particle size distribution in which D16(v)/D50(v) was 1.10 and D50(p)/D84(p) was 1.35.

EXAMPLE 3

A developer was prepared in the same manner as in Example 1, except that the colorant was replaced by C.I. Pigment Yellow 17, and that in the pulverization and classification steps, toner particles were regulated to have a volume-average particle diameter of 3 μm and a particle size distribution in which D16(v)/D50(v) was 1.35 and D50(p)/D84(p) was 1.36.

EXAMPLE 4

A developer was prepared in the same manner as in Example 1, except that in the pulverization and classification steps, toner particles were regulated to have a volume-average particle diameter of 5 μm and a particle size distribution in which D16(v)/D50(v) was 1.29 and D50(p)/D84(p) was 1.37.

EXAMPLE 5

A developer was prepared in the same manner as in Example 3, except that in the pulverization and classification steps, toner particles were regulated to have a volume-average particle diameter of 9 μm and a particle size distribution in which D16(v)/D50(v) was 1.10 and D50(p)/D84(p) was 1.20.

EXAMPLE 6

| | |
|---|---|
| (Toner) | |
| Styrene-n-butyl acrylate (80/20) copolymer ($M_w$: 20,000) | 95 parts |
| Colorant (C.I. Pigment Blue 15:3) | 5 parts |

The above ingredients were treated in the same manner as in Example 1 to obtain a toner having a volume-average particle diameter (D50(v)) of 7 μm, a D16(v)/D50(v) of 1.21 and a D50(p)/D84(p) of 1.35. Using the toner, a developer was prepared in the same manner as in Example 1.

COMPARATIVE EXAMPLE 1

A developer was prepared in the same manner as in Example 1, except that in the pulverization and classification steps, toner particles were regulated to have a volume-average particle diameter of 5 μm and a particle size distribution in which D16(v)/D50(v) was 1.33 and D50(p)/D84(p) was 1.40.

COMPARATIVE EXAMPLE 2

A developer was prepared in the same manner as in Example 2, except that in the pulverization and classification steps, toner particles were regulated to have a volume-average particle diameter of 5 μm and a particle size distribution in which D16(v)/D50(v) was 1.40 and D50(p)/D84(p) was 1.40.

COMPARATIVE EXAMPLE 3

A developer was prepared in the same manner as in Example 2, except that in the pulverization and classification steps, toner particles were regulated to have a particle size distribution in which D16(v)/D50(v) was 1.21 and D50(p)/D84(p) was 1.51.

COMPARATIVE EXAMPLE 4

A developer was prepared in the same manner as in Example 3, except that in the pulverization and classification steps, toner particles were regulated to have a particle size distribution in which D16(v)/D50(v) was 1.40 and D50(p)/D84(p) was 1.40.

COMPARATIVE EXAMPLE 5

A developer was prepared in the same manner as in Example 3, except that in the pulverization and classification steps, toner particles were regulated to have a volume-average particle diameter of 2.5 μm and a particle size distribution in which D16(v)/D50(v) was 1.30 and D50(p)/D84(p) was 1.50.

COMPARATIVE EXAMPLE 6

A developer was prepared in the same manner as in Example 3, except that in the pulverization and classification steps, toner particles were regulated to have a volume-average particle diameter of 9.5 μm and a particle size distribution in which D16(v)/D50(v) was 1.10 and D50(p)/D84(p) was 1.3.

(Test)

The thus obtained developers prepared in Examples 1 to 6 and comparative Examples 1 to 6 were, respectively, introduced into a copier (A-color 635, manufactured by Fuji Xerox Co., Ltd.), and copying operations were conducted to evaluate the resulting images. The results obtained are shown in Table 1 below.

TABLE 1

| | D50 | D16 (v)/ D50 (v) | D50 (p)/ D84 (p) | Grain-iness | Blur-ring | Unevenness of gloss *1 | Unevenness of transfer, white dots *2 | Life *3 |
|---|---|---|---|---|---|---|---|---|
| Ex. 1 | 7 | 1.21 | 1.25 | G3 | G1 | G1 | G1 | G2 |
| Ex. 2 | 7 | 1.10 | 1.35 | G1 | G1 | G1 | G1 | G2 |
| Ex. 3 | 3 | 1.35 | 1.36 | G3 | G2 | G1 | G1 | G3 |
| Ex. 4 | 5 | 1.29 | 1.37 | G3 | G1 | G1 | G1 | G2 |
| Ex. 5 | 9 | 1.10 | 1.20 | G2 | G1 | G2 | G1 | G1 |
| Comp. Ex. 1 | 5 | 1.33 | 1.40 | G4 | G1 | G3 | G3 | G2 |
| Comp. Ex. 2 | 5 | 1.40 | 1.40 | G4 | G1 | G4 | G4 | G2 |
| Comp. Ex. 3 | 7 | 1.21 | 1.51 | G3 | G3 | G1 | G1 | G4 |

TABLE 1-continued

| | D50 | D16 (v)/ D50 (v) | D50 (p)/ D84 (p) | Grain-iness | Blur-ring | Unevenness of gloss *1 | Unevenness of transfer, white dots *2 | Life *3 |
|---|---|---|---|---|---|---|---|---|
| Comp. Ex. 4 | 3 | 1.40 | 1.40 | G4 | G2 | G2 | G2 | G4 |
| Comp. Ex. 5 | 2.5 | 1.30 | 1.50 | G4 | G5 | G1 | G1 | >G5 |
| Comp. Ex. 6 | 9.5 | 1.10 | 1.30 | G4 | G1 | G3 | G3 | G1 |
| Ex. 6 | 7 | 1.21 | 1.35 | G1 | G1 | G1 | G1 | G2 |

*1 and *2: Evaluation was made based on comparison with standard samples of five grades ranging from G1 (good) to G5 (poor). The acceptable levels are from G1 to G3.

*3: The life, which shows grade in blurring after 30 kcV, was evaluated based on comparison with standard samples of five grades ranging from G1 (good) to G5 (poor). The acceptable levels are from G1 to G3.

The properties shown in Table 1 were evaluated based on the following criteria. Graininess was determined based on comparison with standard samples of five grades ranging from G1 (good) to G5 (poor); the acceptable graininess levels are from G1 to G3. Blurring was also determined based on comparison with standard samples of five grades ranging from G1 (good) to G5 (poor); G2 is on a practically acceptable level although the image has blurring, while G3 to G5 each is on a practically unacceptable level with considerable blurring.

As is apparent from the above results, the smaller the toner particle diameter, the better the graininess. However, smaller toner particles were more apt to cause blurring. The toners of comparative Examples showed no improvement in graininess despite the reduction in toner particle diameter.

The toners of the inventive Examples were superior to the toners of the comparative Examples in unevenness of gloss, unevenness of transfer, durability and blurring.

EXAMPLE 7

| (Toner) | |
|---|---|
| Polyester binder polymer (terephthalic acid (A)/cyclohexanediol (B)/ethylene oxide adduct of bisphenol A (C) condensate; A/B/C = 50/20/30 (by mole); ($M_w$: 10,000, $M_n$: 3,000)) | 95 parts |
| Colorant (C.I. Pigment Red 57:1) | 5 parts |

The ingredients shown above were kneaded with a twin-screw kneader, and the resulting mixture was pulverized and classified to obtain toner particles having a volume-average particle diameter (D50(v)) of 7 μm. The toner particles had a D16v/D50(v) of 1.21 and a D50(p)/D84(p) of 1.35. Fine silica particles having an average primary particle diameter of 20 nm, which had been treated with 10 wt % dimethyldichlorosilane, were added as a first external additive (external additive 1) to the above-obtained toner particles in such an amount as to give a coverage of 20% based on the total surface area of the toner particles. Further, fine titanium oxide particles having an average primary particle diameter of 15 nm, which had been treated with 12 wt % trimethoxydecylsilane, were added as a second external additive (external additive 2) in such an amount as to give a coverage of 40% based on the total surface area of the toner particles. The resulting mixture was treated with a Henschel mixer and then sifted with a screen having an mesh size of 45 μm.

| (Carrier) | |
|---|---|
| Cu—Zn—Fe cores (50 μm) | 100 parts |
| Fluorine-containing acrylic polymer | 0.5 parts |

The ingredients shown above were mixed by means of a kneader and then dried to obtain carrier particles having a volume-average particle diameter of about 50 μm.

(Developer)

The toner was mixed with the carrier in a weight ratio of 10:100 to prepare a magenta developer.

EXAMPLE 8

A developer was prepared in the same manner as in Example 7, except that external additive 1 was replaced by fine silica particles having an average primary particle diameter of 80 nm.

EXAMPLE 9

A developer was prepared in the same manner as in Example 7, except that the coverage with external additive 2 was changed to 70%.

EXAMPLE 10

A developer was prepared in the same manner as in Example 7, except that in the pulverization and classification steps, toner particles were regulated to have a volume-average particle diameter D50 of 5 μm and a particle size distribution in which D16(v)/D50(v) was 1.24 and D50(p)/D84(p) was 1.32.

EXAMPLE 11

A developer was prepared in the same manner as in Example 10, except that the coverage with external additive 1 was changed to 50%.

EXAMPLE 12

A developer was prepared in the same manner as in Example 10, except that external additive 1 was replaced by fine silica particles having an average primary particle diameter of 80 nm, and that the coverage with external additive 2 was changed to 60%.

EXAMPLE 13

A developer was prepared in the same manner as in Example 7, except that in the pulverization and classification steps, toner particles were regulated to have a volume-average particle diameter D50 of 3 μm and a particle size distribution in which D16(v)/D50(v) was 1.23 and D50(p)/D84(p) was 1.35.

EXAMPLE 14

A developer was prepared in the same manner as in Example 7, except that external additive 1 (fine silica particles of 20 nm) was omitted.

EXAMPLE 15

A developer was prepared in the same manner as in Example 7, except that the coverage with external additive 2 (fine titanium oxide particles of 15 nm) was changed to 30%.

EXAMPLE 16

A developer was prepared in the same manner as in Example 7, except that the coverages with external additives 1 and 2 were each changed to 60%.

EXAMPLE 17

A developer was prepared in the same manner as in Example 7, except that the particle diameter of the fine silica particles as external additive 1 was changed to 40 nm and that of the fine titanium oxide particles as external additive 2 was changed to 7 nm.

The thus obtained developers prepared in Examples 7 to 17 were, respectively, introduced into a copier (A-color 635, manufactured by Fuji Xerox Co., Ltd.), and copying operations were conducted to evaluate the resulting images. The results obtained are shown in Table 2 below.

The above results show that the toners of the Examples according to the present invention showed significantly improved graininess and transferability.

EXAMPLE 18

| (Toner) | |
|---|---|
| Polyester binder polymer (terephthalic acid (A)/cyclohexanediol (B)/ethylene oxide adduct of bisphenol A (C) condensate; A/B/C 50/20/30 (by mole); ($M_w$: 10,000, $M_n$: 3,000, $T_g$: 65° C.)) | 83.4 parts |
| Colorant (colorant prepared by mixing a wet cake of C.I. Pigment Red 57:1 with the above described polyester binder polymer in a proportion of 30 parts (solid pigment amount excluding water) to 70 parts and treating the mixture with a heated kneader to disperse the pigment) | 16.6 parts (pigment, 5.0 parts) |

The ingredients shown above were kneaded with a twin-screw kneader, and the resulting mixture was pulverized and classified to obtain toner particles having a volume-average particle diameter (D50) of 7 μm. The toner particles had a D16(v)/D50(v) of 1.21 and a D50(p)/D84(p) of 1.25. The toner particles had a melt viscosity η(90° C.) of $2\times10^5$ Pa·s and a melt viscosity η(100° C.) of $1.5\times10^4$ Pa·s. Fine silica particles having an average primary particle diameter of 40 nm, which had been surface-treated with hexamethylenesilazane, were added to 100 parts of the above-obtained toner particles in such an amount as to give a coverage of 20% based on the total surface area of the toner particles. Further, fine silica particles having an average primary particle diameter of 20 nm, which had been surface-treated with trimethoxydecylsilane, were added in such an amount as to give a coverage of 40% based on the total surface area of the toner particles. The resulting mixture was treated with a Henschel mixer and then sifted with a screen having an mesh size of 45 μm.

TABLE 2

| | | | | External additive 1 | | External additive 2 | | Graininess | | Transfer-ability | | |
|---|---|---|---|---|---|---|---|---|---|---|---|---|
| | D50 (vol.) | D16/D50 (vol.) | D50/D84 (pop.) | Particle diameter nm | Coverage % | Particle diameter nm | Coverage % | initial | after 10000 sheets | initial | after 10000 sheets | Remarks |
| Ex. 7 | 7 | 1.21 | 1.35 | 20 | 20 | 15 | 40 | G1.5 | G2 | G1 | G1 | |
| Ex. 8 | 7 | 1.21 | 1.35 | 80 | 20 | 15 | 40 | G1 | G1 | G1 | G1 | |
| Ex. 9 | 7 | 1.21 | 1.35 | 20 | 20 | 15 | 70 | G1 | G1 | G1 | G1 | |
| Ex. 10 | 5 | 1.24 | 1.32 | 20 | 20 | 15 | 40 | G2 | G2 | G1 | G1 | |
| Ex. 11 | 5 | 1.24 | 1.32 | 20 | 50 | 15 | 40 | G1 | G1 | G2 | G1 | |
| Ex. 12 | 5 | 1.24 | 1.32 | 80 | 20 | 15 | 60 | G1 | G1 | G2 | G1 | |
| Ex. 13 | 3 | 1.23 | 1.35 | 20 | 20 | 15 | 40 | G2 | G2 | G2 | G2 | |
| Ex. 14 | 7 | 1.21 | 1.35 | — | — | 15 | 40 | G2 | G3 | G2 | G3 | |
| Ex. 15 | 7 | 1.21 | 1.35 | 20 | 20 | 15 | 30 | G1.5 | G3 | G1 | G2 | toner feed failure |
| Ex. 16 | 7 | 1.21 | 1.35 | 20 | 20 | 15 | 60 | G1 | G1 | G1 | G1 | comets occurred |
| Ex. 17 | 7 | 1.21 | 1.35 | 40 | 20 | 7 | 40 | G1 | G1 | G1 | G1 | |

The properties shown in Table 2 were evaluated based on the following criteria. Graininess was determined based on comparison with standard samples of five grades ranging from G1 (good) to G5 (poor); the acceptable graininess levels are from G1 to G3. Transferability (white dots) was also determined based on comparison with standard samples of five grades ranging from G1 (good) to G5 (poor); G2 is on a practically acceptable level although white dots are slightly observed, while G3 to G5 each is on a practically unacceptable level with considerable blurring.

| (Carrier) | |
|---|---|
| Cu—Zn—Fe cores (50 μm) | 100 parts |
| Fluorine-containing acrylic polymer | 0.5 parts |

The ingredients shown above were mixed by means of a kneader and then dried to obtain carrier particles having a volume-average particle diameter of about 50 μm.

(Developer)

The toner was mixed with the carrier in a weight ratio of 10:100 to prepare a magenta developer.

(Development)

The developer described above was introduced into a copier (A-color 635, manufactured by Fuji Xerox Co., Ltd.), and development was conducted using a gradation chart. The surface smoothnesses of paper used were 50 sec, 100 sec and 500 sec. The toner amount per unit area used for the development providing a density of 1.7 was 0.5 mg/cm$^2$.

EXAMPLE 19

| (Toner) | |
|---|---|
| Polyester binder polymer (terephthalic acid/glycerol/ethylene oxide adduct of bisphenol A/propylene oxide adduct of bisphenol A, (molar ratio, 50/5/20/25) ($M_w$: 42,000, $M_n$: 3,800, $T_g$: 69° C.)) | 80.1 parts |
| Colorant (colorant prepared by mixing a wet cake of C.I. Pigment Blue 15:3 with the polyester binder polymer in a proportion of 30 parts (solid pigment amount) to 70 parts and treating the mixture with a heated kneader to disperse the pigment) | 19.9 parts (pigment, 6.0 parts) |

The ingredients shown above were kneaded with a twin-screw kneader, and the resulting mixture was pulverized and classified to obtain toner particles having a volume-average particle diameter (D50) of 7 μm. The toner particles had a melt viscosity η(90° C.) of 1×10$^6$ Pa·s, a melt viscosity η(100° C.) of 8.0×10$^4$ Pa·s, a D16(v)/D50(v) of 1.20 and a D50(p)/D84(p) of 1.40. Using the thus obtained toner particles, a developer was prepared, and development using the developer was conducted both in the same manner as in Example 18. The surface smoothnesses of paper used were 50 sec, 100 sec and 500 sec. The toner amount per unit area used for the development providing a density of 1.7 was 0.45 mg/cm$^2$.

EXAMPLE 20

Toner particles were prepared in the same manner as in Example 13, except that the amount of the colorant was changed to 26.6 parts by weight (pigment amount, 8.0 parts). The toner particles thus obtained had a melt viscosity η(90° C.) of 3.0×10$^5$ Pa·s and a melt viscosity η(100° C.) of 2.0×10$^4$ Pa·s. Using the toner particles, a developer was prepared, and development using the developer was conducted both in the same manner as in Example 18. The surface smoothnesses of paper used were 50 sec, 100 sec and 500 sec. The toner amount per unit area used for the development providing a density of 1.7 was 0.4 mg/cm$^2$.

The results obtained in Examples 18 to 20 are shown in Table 3.

TABLE 3

| | D50 (vol.) | D16/D50 (vol.) | D50/D84 (pop.) | Colorant amount (%) | TMA (mg/cm$^2$) | Toner melt viscosity Pa · s η (90° C.) | Toner melt viscosity Pa · s η (100° C.) | Image deterioration Paper SP 50 (sec) | Paper SP 100 (sec) | Paper SP 500 (sec) |
|---|---|---|---|---|---|---|---|---|---|---|
| Ex. 18 | 6.5 | 1.21 | 1.35 | 5 | 0.5 | 2 × 10$^5$ | 1.5 × 10$^4$ | G3 | G1 | G1 |
| Ex. 19 | 7.0 | 1.20 | 1.40 | 6 | 0.45 | 1 × 10$^6$ | 8 × 10$^4$ | G2 | G1 | G1 |
| Ex. 20 | 6.5 | 1.21 | 1.35 | 8 | 0.4 | 3 × 10$^5$ | 2 × 10$^4$ | G3 | G1 | G1 |

In Table 3, image deterioration indicates microscopic gloss unevenness or unevenness caused by projected paper fibers within fixed images. The evaluation of the image deterioration was conducted based on comparison with standard samples of five grades ranging from G1 (good) to G5 (poor), in which the acceptable levels are from G1 to G3.

The above results also show that the toners of the Examples were highly effective in improving graininess.

As described above, the toner for electrostatic-image development and the developer for electrostatic images according to the present invention comprises toner particles regulated to have a volume-average particle diameter of from 3 to 9 μm and a particle size distribution satisfying the above described expressions (1) and (2), to thereby has a particle size distribution which is narrow especially on the larger-particle side. As a result, high-quality images being reduced in unevenness of gloss and unevenness of transfer, good of durability and graininess, and free from blurring can be obtained.

While the invention has been described in detail and with reference to specific examples thereof, it will be apparent to one skilled in the art that various changes and modifications can be made therein without departing from the spirit and scope thereof.

What is claimed is:

1. A toner for electrostatic-image development which comprises toner particles comprising a colorant and a binder resin, said toner particles having a volume-average particle diameter of from 3 to 9 μm and a particle size distribution satisfying the following expressions (1) and (2):

$$D16(v)/D50(v) \leqq 1.475-0.036 \times D50(v) \quad (1)$$

$$D50(p)/D84(p) \leqq 1.45 \quad (2)$$

wherein D16(v) and D50(v) represent, in terms of absolute value, a cumulative 16% diameter (μm) and a cumulative 50% diameter (μm), respectively, of a cumulative volume particle diameter distribution of said toner particles depicted from the larger diameter side, and D50(p) and D84(p)

represent, in terms of absolute value, a cumulative 50% diameter ($\mu$m) and a cumulative 84% diameter ($\mu$m), respectively, of a cumulative population particle diameter distribution of said toner particles depicted from the larger diameter side.

2. The toner as claimed in claim 1, having external additives comprising (a) an external additive having an average particle diameter of from not less than 20 nm to less than 100 nm and (b) an external additive having an average particle diameter of from not less than 7 nm to less than 20 nm:

wherein said toner particles are covered with external additive (a) at a coverage of at least 20%, and with external additive (b) at a coverage of at least 40%, of the total surface area of said toner particles; and wherein the total of the coverages with external additives (a) and (b) is from not less than 60% to less than 120% based on the total surface area of said toner particles.

3. The toner as claimed in claim 1, wherein the volume-average particle diameter of the toner particles (D50(v)) has a relationship represented by the following expression (4) with the colorant content in the toner particles (c):

$$22/D50(v) \leqq c \leqq 43/D50(v) \quad (4)$$

wherein c represents the colorant content (wt %).

4. The toner as claimed in claim 1, wherein the toner particles have a melt viscosity satisfying the following expressions (5) and (6):

$$1\times10^5 \leqq \eta(90^\circ\ \text{C.}) \leqq 1\times10^6 \quad (5)$$

$$1\times10^4 \leqq \eta(100^\circ\ \text{C.}) \leqq 1\times10^5 \quad (6)$$

wherein $\eta$(90° C.) and $\eta$(100° C.) represent the melt viscosity (Pa·s) of the toner at 90° C. and 100° C., respectively.

5. A developer for electrostatic images which comprises (A) toner particles comprising a colorant and a binder resin and (B) a carrier, said toner particles having a volume-average particle diameter of from 3 to 9 $\mu$m and a particle size distribution satisfying the following expressions (1) and (2), and said carrier being a resin-coated carrier:

$$D16(v)/D50(v) \leqq 1.475-0.036\times D50(v) \quad (1)$$

$$D50(p)/D84(p) \leqq 1.45 \quad (2)$$

wherein D16(v) and D50(v) represent, in terms of absolute value, a cumulative 16% diameter ($\mu$m) and a cumulative 50% diameter ($\mu$m), respectively, of a cumulative volume particle diameter distribution of said toner particles depicted from the larger diameter side, and D50(p) and D84(p) represent, in terms of absolute value, a cumulative 50% diameter ($\mu$m) and a cumulative 84% diameter ($\mu$m), respectively, of a cumulative population particle diameter distribution of said toner particles depicted from the larger diameter side.

6. The developer as claimed in claim 5, said toner particles having external additives comprising (a) an external additive having an average particle diameter of from not less than 20 nm to less than 100 nm and (b) an external additive having an average particle diameter of from not less than 7 nm to less than 20 nm:

wherein said toner particles are covered with external additive (a) at a coverage of at least 20%, and with external additive (b) at a coverage of at least 40%, of the total surface area of said toner particles; and wherein the total of the coverages with external additives (a) and (b) is from not less than 60% to less than 120% based on the total surface area of said toner particles.

* * * * *